8/28/84 XR 4,467,838

United States Patent [19]

Rheaume

[11] Patent Number: 4,467,838

[45] Date of Patent: Aug. 28, 1984

[54] APPARATUS AND PROCESS FOR PRODUCING WOVEN, NON-LINEAR SHAPES FROM GRAPHITE FABRIC, AND THE LIKE, AND PRODUCTS PRODUCED THEREFROM

[75] Inventor: Walter A. Rheaume, Fullerton, Calif.

[73] Assignee: Textile Products, Incorporated, Anaheim, Calif.

[21] Appl. No.: 466,425

[22] Filed: Feb. 15, 1983

[51] Int. Cl.[3] ..... D03D 49/20; D03D 41/00; D03D 3/00; B63H 11/00

[52] U.S. Cl. ..... 139/305; 139/11; 139/384 R; 156/189; 264/103; 428/408; 428/902

[58] Field of Search ..... 139/305, 306, 11, 13, 139/384 R; 156/189; 264/103; 220/414; 428/408, 902

[56] References Cited

U.S. PATENT DOCUMENTS

| | | | |
|---|---|---|---|
| 3,272,672 | 9/1966 | Lampman et al. | 156/189 |
| 3,719,210 | 3/1973 | Emerson et al. | 139/13 R |
| 4,359,190 | 11/1982 | Pagano | 156/189 X |

FOREIGN PATENT DOCUMENTS

| | | | |
|---|---|---|---|
| 0044760 | 1/1982 | European Pat. Off. | 264/103 |
| 1069282 | 2/1954 | France | 139/305 |
| 47-36227 | 9/1972 | Japan | 139/306 |

*Primary Examiner*—James Kee Chi
*Attorney, Agent, or Firm*—Willie Krawitz

[57] ABSTRACT

Rocket exit cones, and similar components are produced by weaving graphite fibers into fabric and wrapping a continuous length of the woven fabric over a rotating wind up form having a non-linear shape as the fabric leaves the loom. A compensator system is provided to accommodate for the varying distances the fabric must travel from the loom to the non-linear wind up form. During wrapping, the wind up form may be traversed for a short distance across the weaving loom to produce a differential wall thickness between the cylinder portion and the conical portion of the cone. In addition, the traverse motion enables the proper curvature to be imparted to the interface between the cylinder and conical portions of the exit cone.

The built fabric has a controlled shape, which is adapted for resin-impregnation and curing. The cured structure has sufficient integrity that permits machining of the conical portion to a uniform thickness or to a tapered thin wall.

20 Claims, 6 Drawing Figures

APPARATUS AND PROCESS FOR PRODUCING WOVEN, NON-LINEAR SHAPES FROM GRAPHITE FABRIC, AND THE LIKE, AND PRODUCTS PRODUCED THEREFROM

BACKGROUND OF THE INVENTION

This invention relates to a new and improved apparatus and process for producing non-linear exit cones, rocket motors, and similar components for rockets, and the like. If a rocket can be made having a lighter exit cone of good structural integrity, it will consume less fuel, have a longer range, and a launch can be made more quickly and easily, with reduced possibility of detection.

Heretofore, it has not been possible to uniformly wrap a continuous length of fabric such as graphite on non-linear wrapping forms having the shape of, say, an exit cone. Hence, the present fabrication of these types of rocket exit cones usually involves applying rosette sections of graphite cloth to a mandrel, or winding a filament on a mandrel. This is followed by impregnating with resin, and the curing and shaping to its ultimate configuration. These exit cones have non uniform and inadequate structures that lead to frequent catastrophic failures when firing on the pad, or after launch.

To a certain extent, the problem can be compensated by building an exit cone having a thick wall for the conical portion. However, since the conical portion is the heaviest part of the exit cone, this adds considerable weight to the system. Consequently either the range of the rocket is limited, or more fuel is required for launching, thereby imposing restrictions on the rocket design. Also, a heavy exit cone makes it difficult to site and handle the rocket prior to launch, and transporting the device also is difficult.

It would be preferred to produce an exit cone having a conical wall thickness of about ¼ inch, or greater, while improving its tensile properties and structural characteristics. Moreover, if the usual conical wall thickness could be reduced by machining down to this ¼ inch thickness, the weight of the exit cone could be reduced greatly, and this would be extremely useful, particularly if the structural integrity and weight and requirements were improved. A desirable process would produce exit cones of up to about 6 feet in diameter, and up to about 8 feet long.

Also, it would be desireable to produce a uniform transition between the cylinder portion and the conical protion and at the same time conform the junction between the conical and cylinder portions to a desired shape.

A process fo producing an exit cone preferably should be continuous so that important process conditions can be controlled while wrapping the fabric. These process conditions include wrapping seeds, fabric tension, fabric feed rates, traverse times, rates and distance traversed by the wind up form, etc.

In addition, a process for producing an exit cone is desired that would give a fabricator the option of whether or not pressure is applied to the wrapped fabric prior to the resin cure stage.

THE INVENTION

According to the invention, the process and apparatus for producing new and improved exit cones comprises weaving graphite fibers, and the like, into a continuous length of fabric and wrapping the fabric around a compensating system and onto a rotating form having the desired shape and size of an exit cone. The compensating system accommodates for the different distances the fabric must travel under tension because of the non-linear shape of the rotating form and its position relative to the loom. The form is traversed, preferably once, relative to the weaving loom for a short distance during wrapping to impart the required curvature and thickness to the cylinder and conical walls, and to the interface therebetween.

Following wrapping, the built up fabric shape is then impregnated with resin and cured, usually under heat and pressure. After curing, the form is removed, and the end portions of the cured exit cone are trimmed off. The cone is then machined to its final shape and tolerance, and the interior wall of the cylinder is configured such as by threading for attachment to the rocket. Alternatively, following the wrapping step, the fabric shape may be impregnated and lightly cured on the form to impart an initial stiffness, and thereby enable it to be handled. The partially cured fabric shape is then removed from the form and deeply cured to its final state, prior to end trimming and machining.

In addition to fabrics made of graphite fibers, fabrics made from fibers of silicon carbide, quartz, ceramic and the like, either alone or combined with each other may be wrapped into non linear shapes by the process and apparatus of this invention.

DESCRIPTION OF THE PREFERRED EMBODIMENTS

Figure 2:
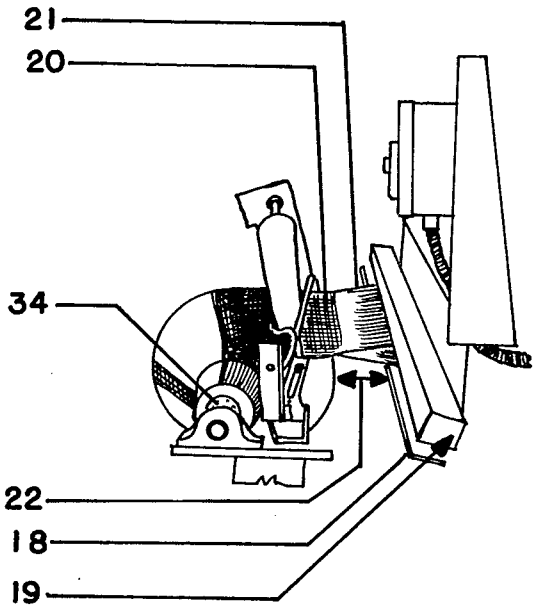
FIG. 2 is an external perspective view of the apparatus in upper side elevation.
Figure 1:
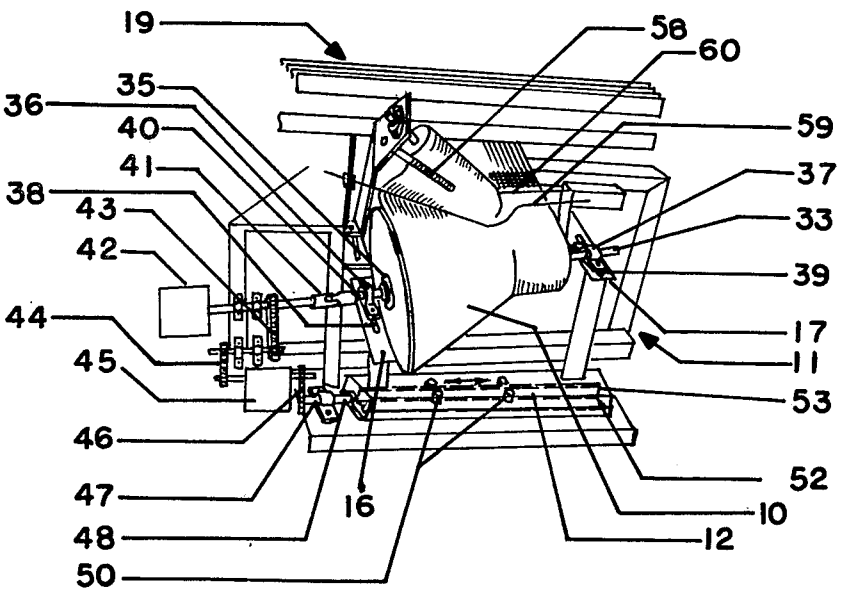
FIG. 1 is an external perspective view of the apparatus in fron elevation showing the fabric being wrapped on a wind up form.
Figure 3:
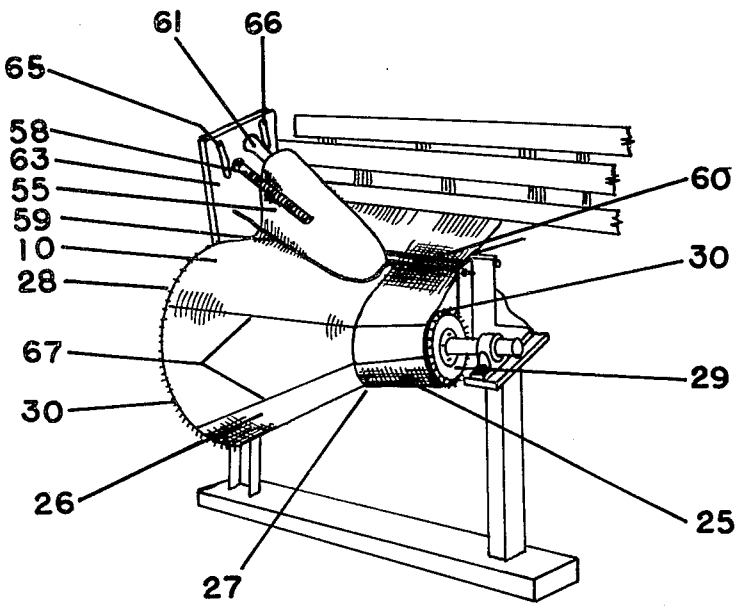
FIG. 3 is an external perspective view of the apparatus in partial side elevation.

The apparatus for producing the exit cone of this invention is shown in FIGS. 1–3, and includes a wind up form 10 mounted within an open framework 11 having a moveable support base 12, vertical support beams, and horizontal side beam rails 16 and 17. The framework 11 and wind up form 10 are positioned adjacent the take off end 18 of a weaving loom 19 (e.g. Crompton & Knowles C-5), and a continuous web of woven graphite fabric 20 is wound therefrom with strands 21. The central axis of the form is inclined from the perpendicular direction of the fabric leaving the loom to avoid distorting the fabric surface during winding. Since the fabric travels for only a short gap distance 22 after it leaves the loom, it can be wound up immediately on the rotating form.

The form 10 is accurately shaped to define a cylindrical portion 25, a conical portion 26, and an interface 27 that may be curved or angular. An engaging groove (not shown) along the wind up roll enables the lead threads of the woven cloth to be engaged and prevents slippage during wind up. Circular end retaining members 28, 29 are mounted at each end of the form 10, and bear a plurality of spikes 30 which are inserted into the form around the periphery near each end. The spikes 30 pass through the fabric while it is wrapped onto the form, and also prevent the fabric from slipping or unwrapping during wind up.

The form 10 is rotatably mounted on a drive shaft 33 that is secured between end plates 34, 35 bolted to the form. Each end of the shaft rotates within pillow blocks 36, 37 on the side rails 16 and 17 and are adjustable along slots 38, 39 of each side rail for positioning with respect to the loom 19.

The drive end 40 of the shaft 33 is powered through a U-joint 41 from a motor 42 and sprocket chain drive 43. The motor 42 also drives a sprocket chain drive 44 through a gear reducing box 45 and sprocket chain drive 46 to a traverse drive shaft 47 mounted to a movable shaft 48. The wind up roll is traversed, usually in a single pass for a short distance relative to the loom while the fabric is being wrapped on the wind up roll. The traverse guides comprise a roller system 50 and a tongue and groove connection (not shown) that move along respective tracks 52, 53 forming the framework 11. Use of the U-joint enables the form 10 to be driven at an angle to the loom. Prior to the manufacture of each subsequent exit cone, the traverse mechanism is backed up to its original setting.

Figure 4:
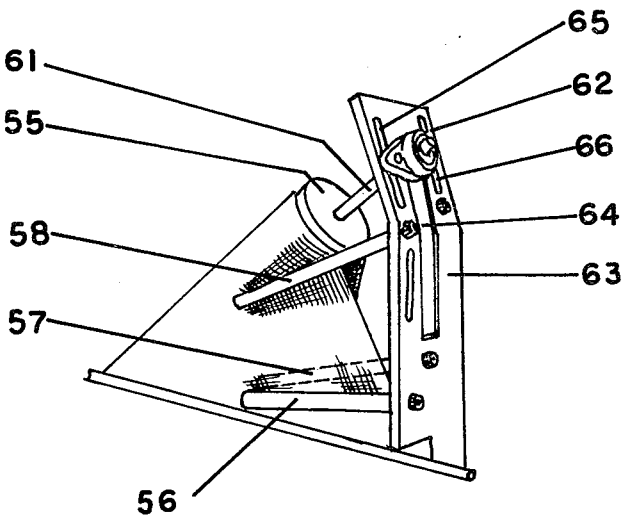
FIG. 4 is an external perspective view of mountings for the tension elements.

A compensating and alignment means are required to accommodate for the different distances which the fabric must travel under tension because of the non-linear shape of the wind up form 10, and its position relative to the loom. This is accomplished, as shown in detail in FIG. 4, using an idler roller 55, rotating alignment bars 56, 57, 58, and contouring bars 59, 60. The idler roller 55 rotates on a shaft 61 that is journalled at one end through a pillow block 62 which is adjustably mounted in a multi-slotted plate 63 which is attached to the open beam framework 11. At the other (i.e. lower) end, the idler roller is supported by a ball and socket (not shown). Slots 64, 65, 66 are provided on the slotted plate 63 to enable vertical movement of the pillow block 62. This permits tension adjustment of the fabric at the same time the idler roller fills a portion of the space 22 between the loom 19 and the wind up form 10.

In operation, following weaving of the graphite fibers 21 in the loom 19, a continuous length of the woven graphite fabric 20 is passed between the rotating alignment bars 56, 57 that are offset to maintain fabric alignment. The fabric is then passed over the alignment-tension bar 58 and around the idler roller 55, which are also offset to maintain the fabric aligned. The fabric is then wound up on the wind up form 10 which is rotated by the motor 42 through the drive shaft 33. As the fabric is wound up on the wind up form 10, it is passed onto the spikes 30 that secures the fabric against slippage movement, unwrapping, etc.

Typically, for every forty revolutions of the wind up roll, it will traverse a distance of about two inches across the loom. This will obtain a 2 inch cylinder wall, a 1 inch cone wall, a 10 inch diameter cylinder, a 22.5 inch diameter cone portion, and a 27 inch end-to-end exit cone.

If the cylinder and conical walls of the exit cone are designed to have the same wall thickness, the same weave may be used for both these areas, and no traverse movement is required. However, if the cylindrical wall is manufactured comparatively thicker than the conical wall, to accommodate for subsequent internal threading, the loom weave over the cylindrical portion 25 may utilize a thicker weave such as a 40 thread/inch of 12 harness satin, and the conical portion 26 would use a lighter weave, such as a plain weave of say, 20 threads/inch. Also, as indicated, during rotation of the wind up form 10, it is traversed horizontally for a short distance; this traverse movement will additionally control the wrapping contour at the interface 27 of the form 10. This contour will depend on the shape of the form 10 which in turn is determined by the exit cone design. The contouring bars 59, 60 are configured to conform the proper curvature of a particular fabric with the shape of the wind up form, and the bars are pressured into the fabric to ensure a close, uniform wrapping. The specific shape of a contour bar is a matter of empirical design.

To monitor and control wrapping uniformity, a light colored tracer thread 67 of, say Dacron, may be woven at intervals into the graphite fabric parallel to its width, although it is probably not essential to the process. If the threads retain a reasonable linearity during the fabric build up, the fabric may be considered to be wrapped uniformly. However, if the threads deviate from an acceptable standard of linearity, the fabric wrapping can be varied by adjusting the positioning and shape of the contour bars, fabric feed rate, drive shaft speed, traverse times and distance, etc.

Figure 5:
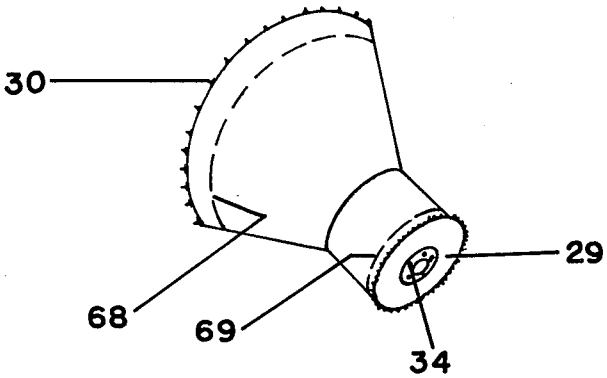
FIG. 5 is a perspective view of the woven fabric mounted on the wind up form, prior to curing; and, FIG. 6 is a view in sectional side elevation of the finished exit cone.

When the wrapping process has produced an exit cone structure shape of sufficient thickness, the structure may be reinforced. This reinforced wrapping is then impregnated with a resin that yields a high char residue such as phenolics, epoxy, polyimide, etc. The impregnated wrapping may be compressed to increase fiber density, and cured generally under heat and pressure. The curing will also burn out the Dacron tracer thread. As shown in FIG. 5, the wind up form 10 is then removed, and the ends of the cured structure are trimmed 68, 69 for proper sizing.

Figure 6:
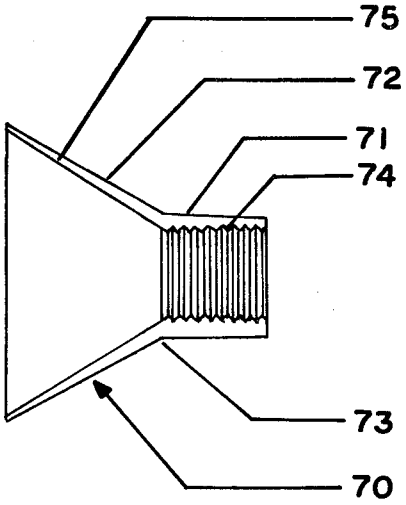

Finally, as shown in FIG. 6, the cured, integral structure is machined internally and externally to its ultimate exit cone shape 70 having a cylindrical portion 71, conical portion 72, and a curved interface 73. The cylindrical portion is then threaded 74 or otherwise machined on the inside wall for attachment to a rocket. The conical wall 75 is shown as being machined to a tapered shape, but this is merely an optional design, and the conical wall could be of uniform thickness.

I claim:

1. A process for producing a fabric wrapping having a non-linear shape suitable for conversion into an exit cone, rocket motor, and the like, comprising the steps of:

(a) weaving a continuous, single length of fabric in a loom;

(b) continuously wrapping the fabric as it leaves the loom and onto a rotating, non-linear wind up form inclined to the loom, to produce an integral wrapped shape, the wind up form defining a conical portion, a cylindrical portion, and an interface between the conical and cylindrical portions;

(c) tensioning, contouring and aligning the fabric during the wrapping step by passing the fabric through adjustable contouring, tensioning and alignment roller means and bar means inclined to the loom;

(d) pressuring the contouring means onto the wrapped-up fabric to maintain a close, uniform wrapping;

(e) weaving a thicker cylindrical portion than a conical portion;

(f) offsetting the direction of fabric travel from the loom to the wind up form to compensate for the different distances of fabric travel; and, (g) traversing the form relative to the loom for a short distance in a single pass to control the wrapping contour at the interface and produce a suitably curved interface shape; whereby, the wrapped fabric shape has the property of being adapted for: (i) impregnating with resin; (ii) curing the resin; (iii) removal of the resin-impregnated, cured fabric from the wind up form; (iv) trimming and machining the cured fabric to produce a uniformly curved exit cone having a curved interface; and (v) providing internal threads in the cylindrical portion.

2. The process of claim 1, in which the contouring is produced by at least one contouring bar, alignment is produced by offset rollers and an idler roller positioned upwardly of the wind up form.

3. The process of claim 1, in which the wind up form is traversed relative to the loom during the wrapping step to produce a suitable interface shape and to control the wall thickness.

4. The process of claim 1, in which the cylindrical portion of the fabric wrapping is provided with a thicker wrapping of fabric than the conical portion.

5. The process of claim 1, in which the fabric is produced from fibers selected from the class consisting of: graphite, ceramic, silicon carbide, quartz, and mixtures thereof.

6. The process of claim 1, in which the wrapping speeds, fabric tension, fabric feed rates, traverse times, traverse rates, and distance traversed by the wind up form are controlled while wrapping the fabric.

7. The process of claim 1, in which the fabric wrapped shape is up to about 6 feet in diameter, and up to about 8 feet long, and having a conical wall thickness exceeding about $\frac{1}{4}''$.

8. An apparatus for producing a fabric wrapping having a non-linear shape suitable for conversion into an exit cone, rocket motor, and the like, comprising:

(a) loom means for producing a continuous, single length of woven fabric and for weaving a thicker cylindrical portion than a conical portion of the exit cone;

(b) a rotatable, non-linear wind up form inclined to and adjacent the loom for continuously wrapping the fabric as it leaves the loom to produce an integral wrapped shape, the wind up form defining a conical portion, a cylindrical portion, and an interface between the conical and cylindrical portions;

(c) roller and bar means inclined to the loom for passing the fabric therethrough and adapted to tension, contour and align the fabric during the wrapping step, the contouring means being adapted for pressuring onto the wrapped-up fabric to maintain a close, uniform wrapping;

(d) compensating means for offsetting the direction of fabric travel from the loom to the wind up form to accommodate for the different distances of fabric travel; and, (e) means for traversing the form relative to the loom for a short distance in a single pass to control the wrapping contour at the interface and produce a suitably curved interface shape; whereby, the wrapped fabric shape has the property of being adapted for:

(i) impregnating with resin; (ii) curing the resin; (iii) removal of the resin-impregnated, cured fabric from the wind up form; and, (iv) trimming and machining the cured fabric to produce a uniformly curved exit cone having a curved interface.

9. The apparatus of claim 8, in which the contouring is produced by at least one contouring bar, and alignment is produced by offset bars and an idler roller positioned upwardly of the wind up form.

10. The apparatus of claim 8, in which the wind up form is traversed relative to the loom to produce a suitable interface shape and to control wall thickness.

11. The apparatus of claim 8, in which the cylindrical portion of the fabric wrapped shape is provided with a thicker wrapping of fabric than the control portion.

12. The apparatus of claim 8, in which the fabric is produced from fibers selected from the class consisting of: graphite, ceramic, silicon carbide, quartz and mixtures thereof.

13. The apparatus of claim 8, in which the wrapping speeds, fabric tension, fabric feed rates, traverse times, traverse rates, and distance traversed by the wind up form are controlled while wrapping the fabric.

14. The apparatus of claim 8, in wich the fabric wrapped shape is up to about 6 feet in diameter and up to about 8 feet long.

15. An integrally woven fabric shape suitable for forming into an exit cone, rocket motor, and the like, having a non-linear shape, and produced by the steps, comprising:

(a) weaving a continuous, single length of fabric in a loom;

(b) continuously wrapping the fabric as it leaves the loom and onto a rotating, non-linear wind up form inclined to the loom, to produce an integral wrapped shape, the wind up form defining a conical portion, a cylindrical portion, and an interface between the conical and cylindrical portions;

(c) tensioning, contouring and aligning the fabric during the wrapping step by passing the fabric through adjustable contouring, tensioning and alignment roller means and bar means inclined to the loom;

(d) pressuring the contouring means onto the wrapped-up fabric to maintain a close, uniform wrapping;

(e) weaving a thicker cylindrical portion than a conical portion;

(f) offsetting the direction of fabric travel from the loom to the wind up form to compensate for the different distances of fabric travel; and, (g) traversing the form relative to the loom for a short distance in a single pass to control the wrappint contour at the interface and produce a suitably curved interface shape;

whereby, the wrapped fabric shape has the property of being adapted for: (i) impegnating with resin; (ii) curing the resin; (iii) removal of the resin-impregnated, cured fabric from the wind up form; (iv) trimming and machining the cured fabric to produce a uniformly curved exit cone having a curved interface; and (v) providing internal threads in the cylindrical portion.

16. The fabric wrapped shape of claim 15, in which the cylindrical portion is provided with a thicker wrapping of fabric than the conical portion.

17. The fabric wrappd shape of claim 15, in which the fabric is produced from fibers selected from the class consisting of: graphite, ceramic, silicon carbide, quartz, and mixtures thereof.

18. The fabric wrapped shape of claim 15, having a diameter up to about 6 feet, and a length up to about 8 feet.

19. The fabric wrapped shape of claim 15, in which wrapping speeds, fabric tension, fabric feed rates, traverse times, traverse rates, and distance traversed by the wind up form are controlled while wrapping the fabric.

20. The fabric wrapped shape of claim 15, in which contouring is produced by at least one contouring bar, and alignment is produced by offset bars and an idler roller positioned upwardly of the wind up form.

* * * * *